United States Patent [19]

Ralph et al.

[11] Patent Number: 4,589,314

[45] Date of Patent: May 20, 1986

[54] FILM CUTTER

[75] Inventors: Brian Ralph, 320 S. Beachwood Dr., Burbank, Calif. 91506; Martin Mueller, Coeur d'Alene, Id.

[73] Assignee: Brian Ralph, Burbank, Calif.

[21] Appl. No.: 737,712

[22] Filed: May 28, 1985

[51] Int. Cl.[4] ..... B26D 5/42; B26D 7/02

[52] U.S. Cl. ..... 83/144; 83/157; 83/374; 83/375; 83/456; 83/544; 83/601; 83/607; 83/926 J; 156/505

[58] Field of Search ..... 83/144, 157, 374, 375, 83/456, 544, 601, 607, 926 J; 156/505, 506, 517

[56] References Cited

U.S. PATENT DOCUMENTS

| | | | |
|---|---|---|---|
| 1,155,361 | 10/1915 | Lynch | 83/144 |
| 2,923,195 | 2/1960 | Reibel et al. | 83/607 |
| 3,169,896 | 2/1965 | Dresser | 83/607 X |
| 3,233,489 | 2/1966 | Quarve | 83/607 X |
| 3,461,022 | 8/1969 | Jorgensen | 156/505 |
| 3,709,079 | 1/1973 | Würker | 83/607 X |
| 3,913,433 | 10/1975 | Matthews | 83/607 X |

*Primary Examiner*—Frank T. Yost
*Attorney, Agent, or Firm*—Thomas I. Rozsa

[57] ABSTRACT

The present invention relates to an apparatus for cutting motion picture film negatives. The improvements in the present invention film cutting apparatus enable the film cutter to cut the motion picture film negative with a precise, even, clean cut at a location mid-way between adjacent frames of film footage. This is necessary when using a new technique of negative cutting and splicing that allows no frame loss and still maintains all of the requirements of professional (state of the art) motion picture film processing. This has never before been done. The improvements include individual film seating plates which press the lengths of motion picture film to be cut against individual film support and ejection plates to assure that the lengths of film are securely held prior to and during the cutting operation. The present invention also provides safety features to assure that the operator will not accidentally cut himself during the operation.

1 Claim, 9 Drawing Figures

FILM CUTTER

BACKGROUND OF THE INVENTION

1. Field of the Invention

The present invention relates to devices which are used to cut lengths of motion picture film in the widthwise direction so that appropriate segments of film can be spliced together to form a completed motion picture film story. The film cutter with which the present invention is concerned is used to cut lengths of original motion picture film negative to produce the master from which duplicates will subsequently be made.

2. Description of the Prior Art

All negative film cuts made for the purpose of conforming the original camera negative to the final edited copy of a motion picture film are conventionally and currently made through the center of a frame of negative footage. In order not to destroy valuable negative footage, it is advantageous to cut the negative directly between adjacent frames of film. Negative cutting in the prior art provides primarily for cutting through the center of frames.

SUMMARY OF THE PRESENT INVENTION

The present invention relates to an apparatus for cutting motion picture film negative. The present invention film cutting apparatus enables the film cutter to cut the motion picture film negative with a precise, even, clean cut at a location mid-way between adjacent frames of film footage. The improvements include individual film seating plates which press the lengths of motion picture film to be cut on a set of camera type register pins that perfectly fit the perforations in the negative and against individual film support and ejection plates to assure that the lengths of film are securely held prior to and during the cutting operation. The present invention also provides safety features to assure that the operator will not accidentally cut himself during the operation.

It has been discovered, according to the present invention, that if individual film seating plates which are designed to contact none of the photographed area are used to press the length of motion picture film to be cut against a support surface and are further securely held against the film strip while it is being cut, then a smooth, accurate and even cut across the width of the film is assured.

It has also been discovered, according to the present invention, that if the ejection plates provide for the negative to be lifted off the pins during the cutting operation, no tearing, stretching, cracking or other damage will occur to the perforations of the film during the cutting process.

It has further been discovered, according to the present invention, that if individual film ejection plates are provided beneath both sides of the cut lengths of motion picture film, then either side of the cut length of film can be ejected, while the other side remains on the film cutter. This permits a second length of film to be cut to be placed on top of the film cutter and cut such that a portion of the second length of film can be taped to the remaining portion of the first length of film to be spliced at the next operation in the assembly of the process.

It has additionally been discovered, according to the present invention, that if an apparatus is provided to permit both film ejection plates to rise at the same time, then the portion of two lengths of film which have been taped together can be removed simultaneously to assure that the temporary taping will remain intact.

It has also been discovered, according to the present invention, that if the cutting knife assembly is supported on a lever arm and further designed so that a portion of the assembly protrudes forward of the knife and comes into contact with a portion of the base plate if the knife is in the exposed position, then the forward protrusion provides a safety means which prevents the knife from coming down and in contact with the base plate and length of film thereon, to assure that the operator will not accidentally cut himself. The protrusion is further designed to permit the knife assembly to come in contact with the base plate and film only if the knife is in the fully retracted and sheathed position.

It is therefore an object of the present invention to provide a film cutting apparatus which will securely hold the length of motion picture film to be cut just prior to it being cut, during the cutting process, and after it is cut, to assure accuracy.

It is additionally an object of the present invention to provide camera ready type sprocket register pins which permit the length of motion picture film to be cut to be seated on the film cutter, such that the cut will be made precisely at a distance between adjacent frames of motion picture film, rather than have the cut made within a frame of motion picture film. This further assures that no film footage will be lost.

It is a further object of the present invention to provide a film cutter which has film ejection plates which provide the operator with the option of ejecting one side of film which has been cut or simultaneously ejecting both sides of film which have been cut, without damage to the perforations or sprocket holes in the film.

It is an additional object of the present invention to provide a film cutter with several safety features to assure that the operator will not be cut with the film cutting knife. One such feature prevents the knife from coming in contact with the film negative and base support plate on which the film rests if the knife is in the fully exposed position while it is being lowered. A second safety feature provides for a locking mechanism and that its secondary function serves to maintain the body of the film cutting knife in a closed position until after the length of film has been cut, and until the operator releases the knife mechanism.

Further novel features and other objects of the present invention will become apparent from the following detailed description, discussion and the appended claims, taken in conjunction with the drawings.

DRAWING SUMMARY

Referring particularly to the drawings for the purpose of illustration only and not limitation, there is illustrated:

DETAILED DESCRIPTION OF THE PREFERRED EMBODIMENT

Although specific embodiments of the invention will now be described with reference to the drawings, it should be understood that such embodiments are by way of example only and merely illustrative of but a small number of the many possible specific embodiments which can repreeent applications of the principals of the invention. Various changes and modifications obvious to one skilled in the art to which the invention pertains are deemed to be within the spirit, scope and contemplation of the invention as further defined in the appended claims.

Figure 1:
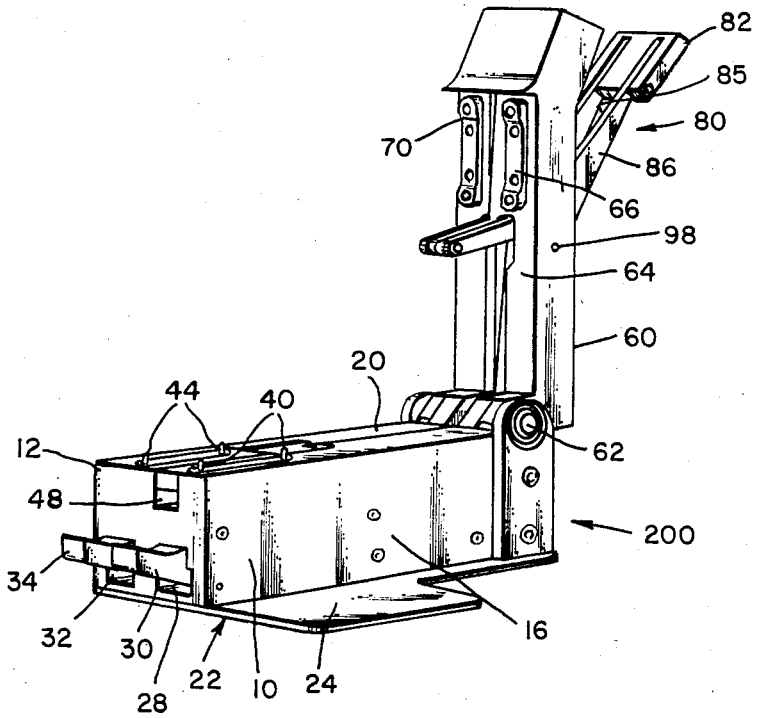
FIG. 1 is a perspective view of the present invention Film Cutter.

The Film Cutter 200 shall first be described through its externally visible components and then a detailed description of the working internal mechanism will be set forth. The externally visible members of the Film Cutter 200 are best seen through a combination of FIGS. 1, 2, 3 and 4. The Film Cutter 200 comprises a hollow base member 10 which contains a front wall 12, a rear wall 14, a first side wall 16, a second side wall 18, a top 20 and a bottom 22. The base member 10 is stabilized by first base plate 24 located adjacent first side wall 16 and extending approximately even with the front wall 12. Also stabilizing base member 10 is second base plate 26, located adjacent second side wall 18 and extending approximately even with rear wall 14. As shown in FIG. 1, the base member 10 is generally rectangular in shape, with the supporting base plates located along oppositely disposed longitudinal side walls. This configuration provides for a very stable Film Cutter 200.

The front wall 12 of base member 10 contains first opening 28 which accommodates a first finger pedal 30 and a second opening 32, which accommodates a second finger pedal 34. Openings 28 and 32 are located adjacent the lower portion of front wall 12 and are spaced apart from each other. As will be described later on, first and second fingwer pedals 30 and 34 initially rest adjacent the upper portion of the respective openings 28 and 32. There is sufficient room in the openings 28 and 32 to permit the respective finger pedals 30 and 34 to be lowered by depressing the finger pedals downwardly.

Figure 2:
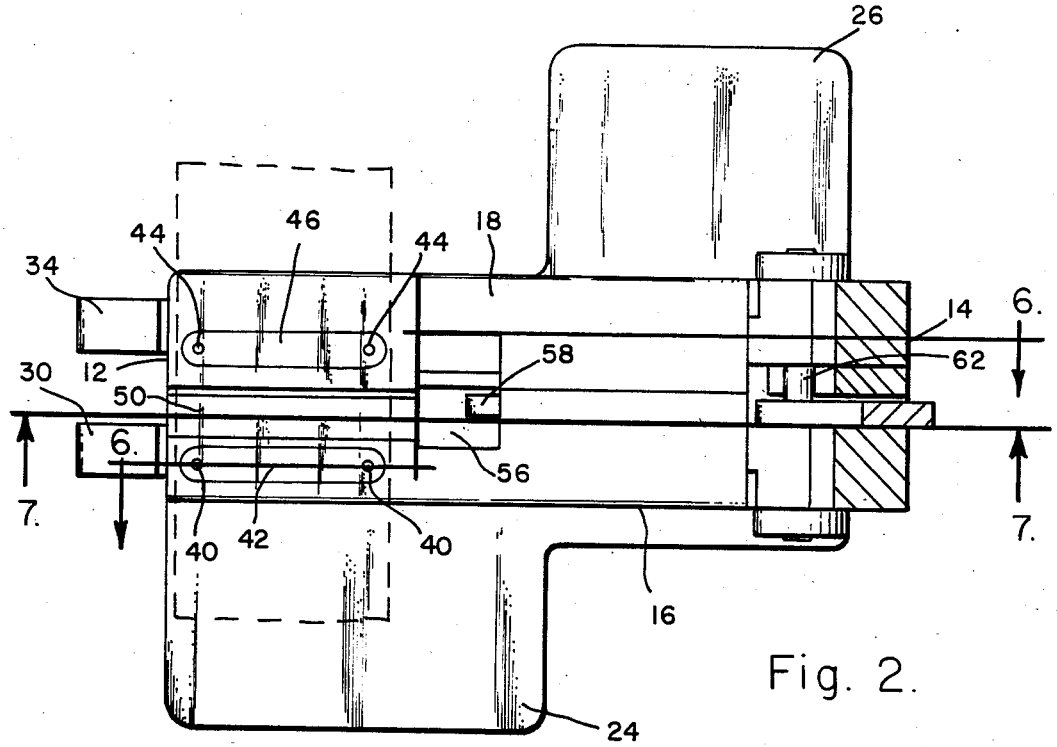
FIG. 2 is a top plan view of the present invention Film Cutter.
Figure 4:
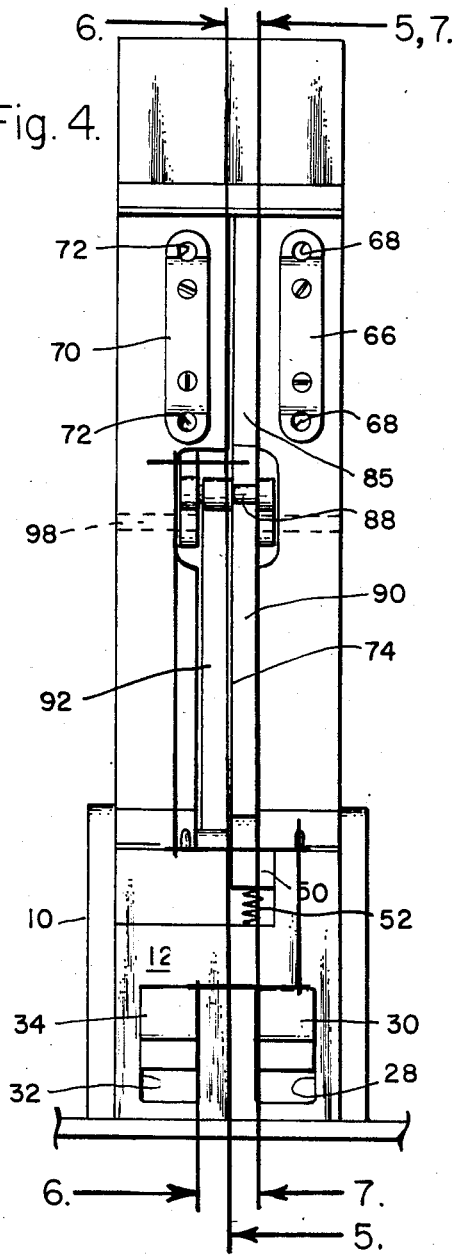
FIG. 4 is a front elevational view of the present invention Film Cutter in the opened position.
Figure 7:
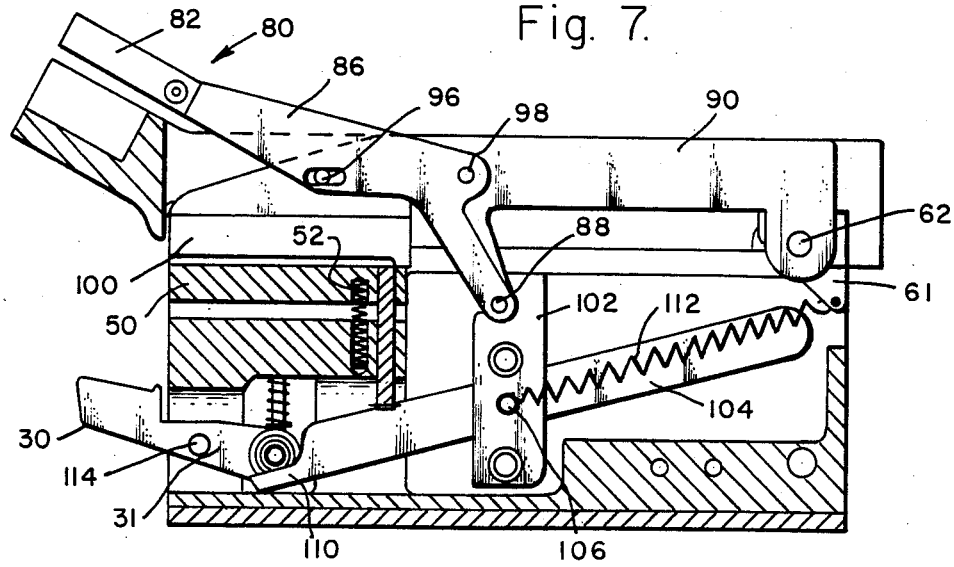
FIG. 7 is a cross-sectional view of the Film Cutter taken along line 5—5 of FIG. 4, but with the Film Cutter in the closed position and the film cutting blade fully activated.

The top 20 of base member 10 comprises a first fixed pair of register pins 40 and a second fixed pair of register pins 44. Each pair of register pins 40 and 44 are spaced apart by the widthwise distance between the sprocket holes on the desired length of film to be cut. For example, if the film to be cut is 35 mm motion picture film, then the midline distance between the fixed pair of register pins of first pair of register pins 40 is aproximately equal to the distance between the centers of sprocket holes in conventional 35 mm motion picture film. Similarly, the mid-line distance between the fixed pair of register pins of the second pair of register pins 44 would also be approximately equal to the distance between the centers of sprocket holes in conventional 35 mm motion picture film. The first pair of register pins 40 are surrounded by a first movable film ejection plate 42. Similarly, the second pair of register pins 44 are surrounded by a second movable film ejection plate 46. As best illustrated in FIG. 2, the first fixed pair of register pins 40 and first film ejection plate 42 are aligned with first finger pedal 30. As will be described in more detail later on, when first finger pedal 30 is depressed, first film ejection plate 42 is caused to rise upwardly. Similarly, second fixed pair of register pins 44 and second film ejection plate 46 are aligned with second finger pedal 34. When second finger pedal 34 is depressed, second film ejection plate 46 is caused to rise upwardly. As shown in FIGS. 1 and 4, top 20 contains a generally rectangular shaped opening 48 located between the pairs of register pins and film ejection plates. The opening is offset to be closer to the first pair of register pins and first ejection plate. Located within opening 48 is movable film support plate 50. In its at rest position, the movable film support plate 50 is located at the top of opening 48 so that its upper surface is approximately even with the top 20 of base member 10. There is sufficient room in opening 48 to permit the movable film support plate 50 to move downwardly. As shown in FIG. 7, movable film support plate 50 is supported by spring 52. The top 20 also contains a downwardly extending opening 56 located behind the film ejection support plate 50. Located at the rear of opening 56 is fixed hook member 58.

Figure 3:
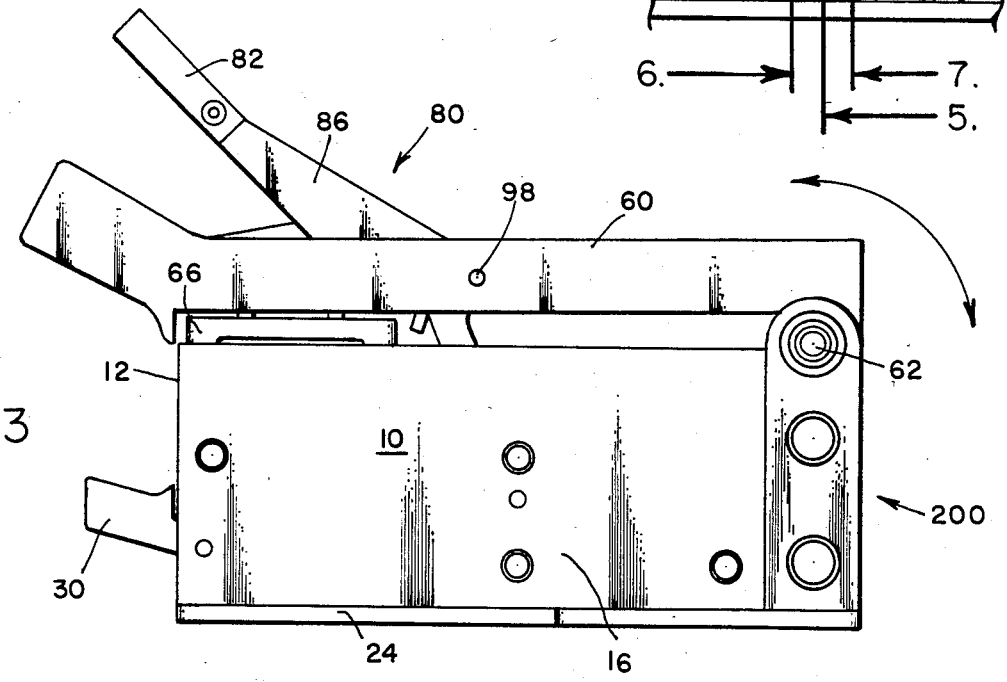
FIG. 3 is a side elevational view of the present invention Film Cutter in the fully closed position.

In addition to the base and its associated components previously described, the second major externally visible component of the Film Cutter 200 is a movable knife support lever 60. The movable knife support lever 60 is rotatably supported on a shaft 62 located adjacent the top rear of the base member 10. In its at rest position, the movable knife support lever is at generally right angles to the base, as shown in FIG. 1. The movable knife support lever can be rotated about said shaft 62 so as to come in contact with the top of said base, as shown in FIG. 3. The front face 64 of movable knife support lever 60 contains contains a first film seating plate 66 and a second film seating plate 70. As shown in FIG. 4, first film seating plate 66 contains a pair of spaced openings 68. Second film seating plate 70 contains a pair of spaced openings 72. The seating plates and openings are aligned with respective film ejection plates and register pins on base 10. When the knife support lever 60 is brought to its closed position through an approximate 90 degree counterclockwise rotation as shown in FIG. 3, first film seating plate 66 is aligned with first film ejection plate 42 and first pair of register pins 40 are accommodated within openings 68. Similarly, ejection plate 46 and second pair of register pins 44 are accommodated within openings 72.

Figure 5:
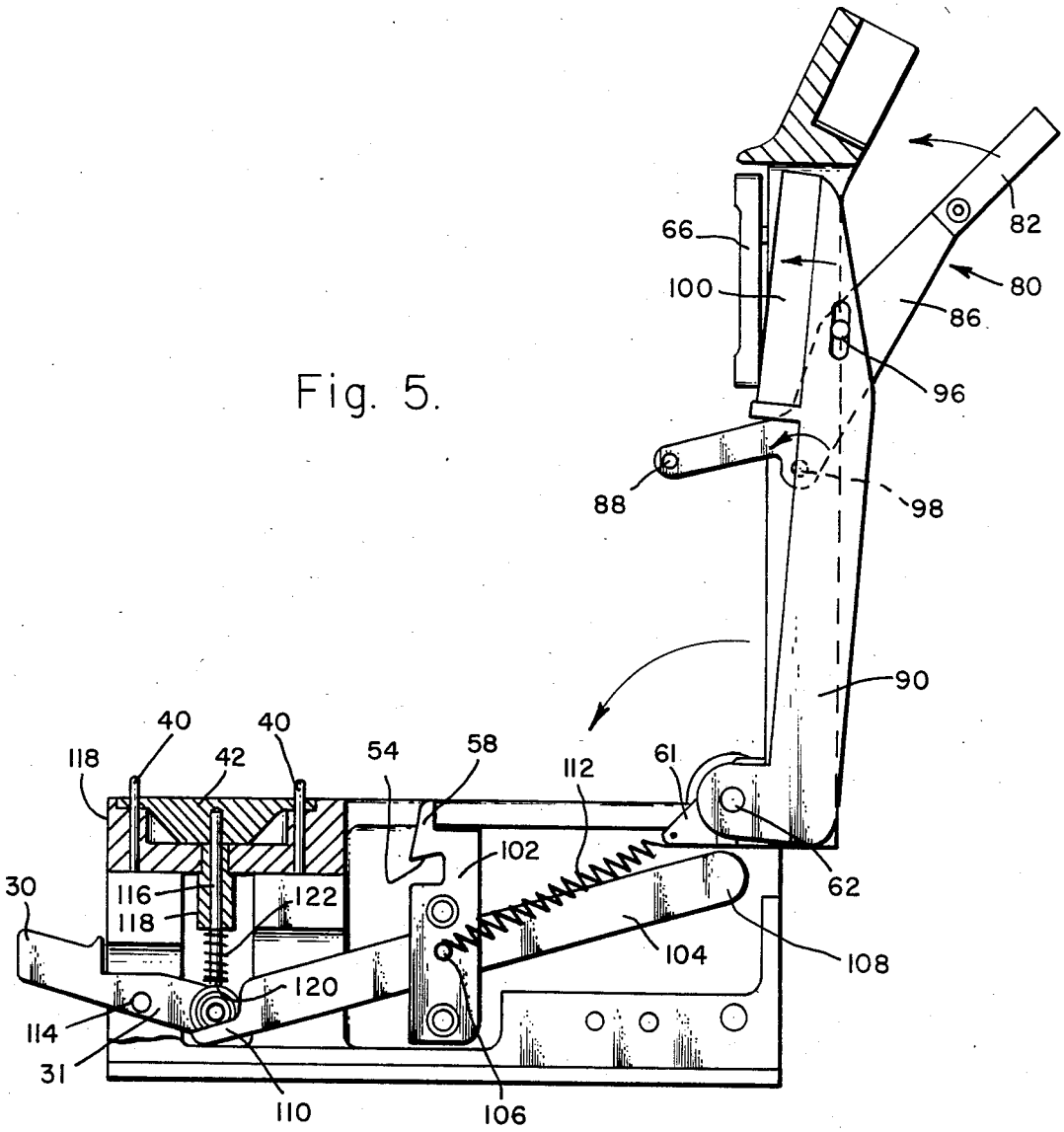
FIG. 5 is a cross-sectional view taken along line 5—5 of FIG. 4.
Figure 6:
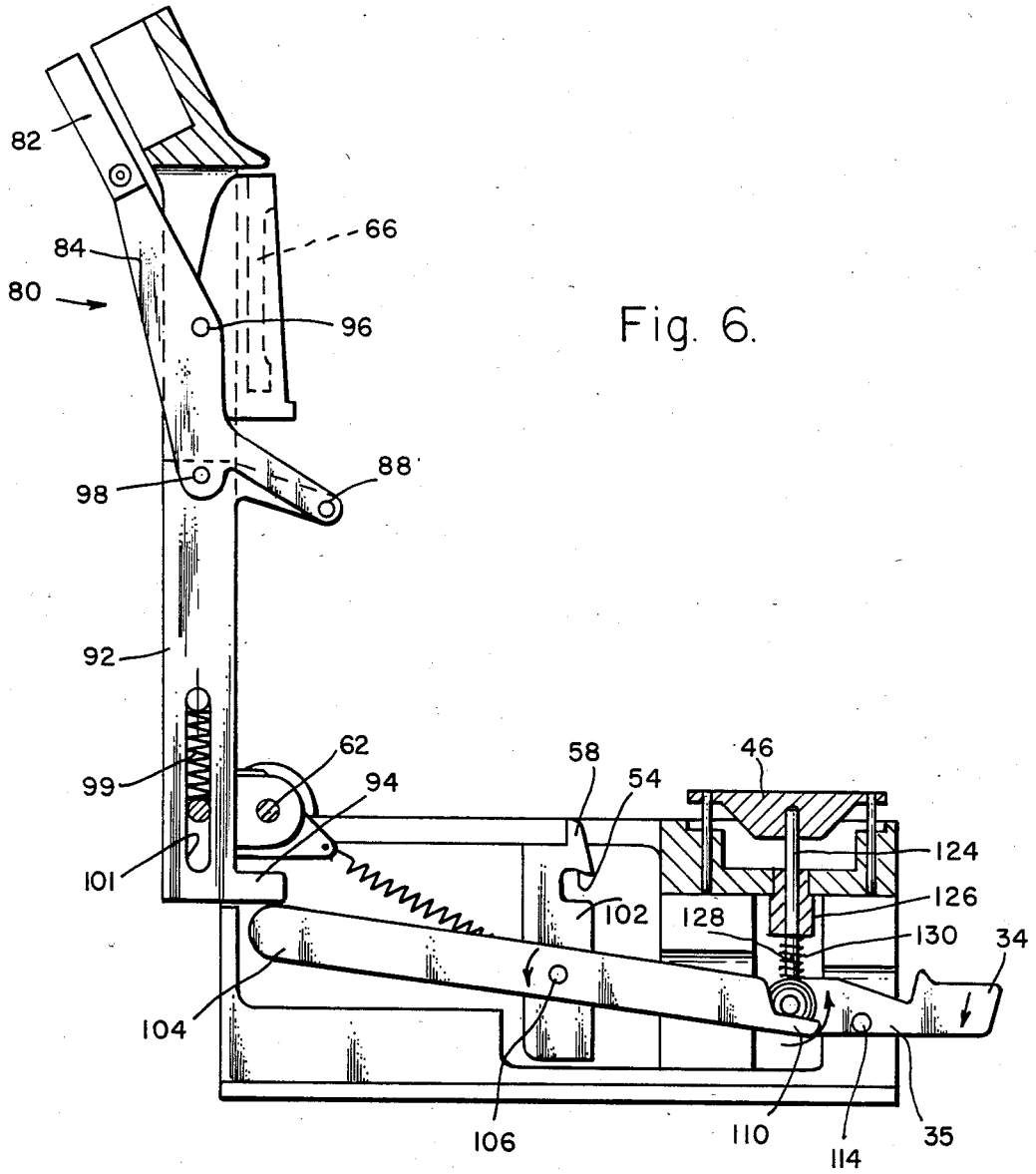
FIG. 6 is a cross-sectional view taken along line 6—6 of FIG. 4 and showing the finger pedal in operation with the film ejection plate in the raised position.

Movable knife support lever 60 contains a centrally disposed longitudinal opening 74 which extends through the entire thickness of the movable knife support lever 60. Supported on movable knife support lever 60 is a movable knife actuating assembly 80. The movable knife actuating assembly is best illustrated in FIGS. 5 and 6. The movable knife actuating assembly 80 comprises the following elements. A handle member 82, which extends into a part of spaced apart handle arms 84 and 86. First handle arm 84 is shown in FIG. 6 while second handle arm 86 is shown in FIG. 5. The two handle arms 84 and 86 are joined at their forward end through shaft 88. The handle arms are pivotally and rotatably supported on a pair of longitudinal arms 90 and 92 which fit within longitudinal opening 74 and also extend into the space 85 between the first and second handle arms 84 and 86. As shown in FIG. 5, first longitudinal arm 90 is rotatbly supported on shaft 62, which also rotatably supports the movable knife support lever 60. The first longitudinal arm 90 also serves to pivotally support the pair of handle arms 84 and 86 through shaft 96. The shaft 96 extends transversely through first handle arm 84, through first longitudinal arm 90 and through second handle arm 86. As shown in FIG. 4, first longitudinal arm 90 is offset in longitudinal opening 74 to be adjacent first handle arm 84. Second longitudinal arm 92 is slidably supported within opening 74 by shaft 88. Shaft 88 extends through first handle arm 84, second longitudinal arm 92 and second handle arm 86. Shaft 98 also extends through one-half of movable knife support lever 60 as well as through longitudinal arm 92 and and handle arm 84 to lend additional support. The second half of shaft 98 extends through one-half of movable knife support lever 60 as well as through longitudinal arm 90 and handle arm 86. Second longitudinal arm 92 moves vertically downward when handle 82 is moved towards movable knife support lever 60. As shown in FIG. 6, the lower portion of second longitudinal arm 92 contains a transverse protrusion 94. As shown in FIG. 5, the forward upper portion of first longitudinal arm 90 is the film cutting knife 100. The above comprises the movable knife actuating assembly 80.

Having thus described the externally visible portionmof the film cutter 200, the internal opertaing mechanisms will now be described with particular reference to FIGS. 5, 6 and 7. The internal opertaing mechanisms are housed within hollow base member 10. As shown in FIGS. 5 and 6, centrally located within the hollow base member 10 is fixed transverse beam 102. The top of beam 102 protrudes into opening 56 on the top 20 of base member 10 as hook member 58. Contained within beam 102 is hook 54. The fixed transverse beam pivotally supports internal lever arm 104 on shaft 106. The rear end 108 of internal lever arm 104 abuts the lower surface of transverse protrusion 94 on second longitudinal arm 92. The lower portion of lever support arm 60 also contains a transverse protrusion 61 as shown in FIG. 5. A spring 112 is connected between transverse protrusion 61 and shaft 106 on fixed transverse beam 102.

First finger pedal 30 extends inwardly into the base member 10 along first finger pedal arm 31. Similarly, second finger pedal 34 extends inwardly into the base member 10 along second finger pedal arm 35. Both finger pedal arms are rotatably supported within the base member 10 on finger pedal shaft 114. The front end 110 of internal lever arm 104 extends downward and abuts the lower rear portion of first finger pedal arm 31 and second finger pedal arm 35.

First film ejection plate 42 is supported by connecting means which includes first film ejection plate support shaft 116, which in turn is supported on the upper surface of first finger pedal arm 31, as shown in FIG. 5. Similarly, second film ejection plate 46 is supported by second film ejection plate support shaft 124 which in turn is supported on the upper surface of second finger pedal arm 35, as shown in FIG. 6. First film ejection plate support shaft 116 contains a wide section 118 which abuts the film ejection plate 42 and a thinner section 120 which abuts the first finger pedal arm 31. A first ejection plate support shaft spring 122 surrounds the thinner section 120 and abuts the lower surface of the wide section 118 as shown in FIG. 5. Similarly, second film ejection ejection plate support shaft 124 contains a wide section 126 which abuts film ejection plate 46 and a thinner section 128 which abuts the second finger pedal arm 35. A second ejection plate support shaft spring 130 surrounds the thinner section 128 and abuts the lower surface of the wide section 126 as shown in FIG. 6.

Movable film support plate 50 is supported within opening 48 by movable film support plate spring 52. Both the shaft and spring abut the bottom of the movable film support plate 50.

Figure 8:
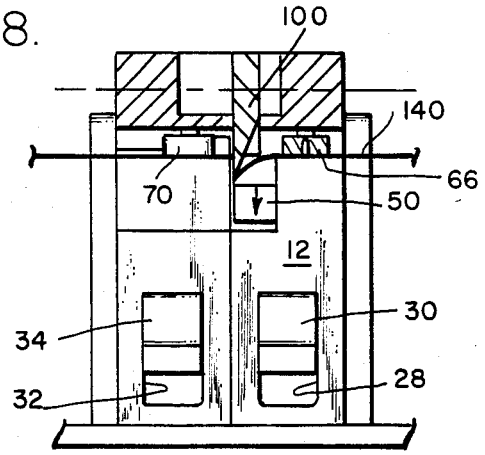
FIG. 8 is a partial front elevational view of the Film Cutter showing the blade lowered and in the process of cutting a length of film.
Figure 9:
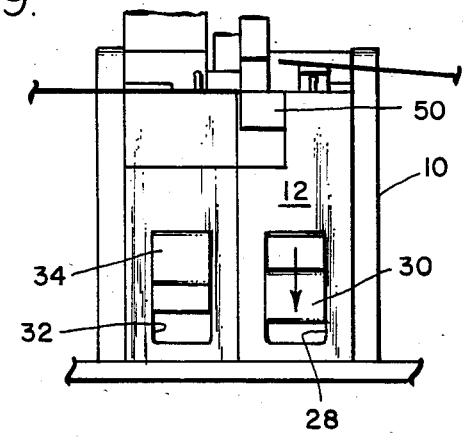
FIG. 9 is a partial front elevational view of the Film Cutter in the opened position after the length of film has been cut with one finger pedal activated to eject one side of the cut length of film.

Having thus described the externally visible and internal parts of the Film Cutter 200, the operation of the present invention will now be described. The object of the Film Cutter 200 is to precisely cut lengths of motion picture film which have been placed on top 20 of base member 10, and adjacent the front 12 of base memebr 10. As shown in FIGS. 8 and 9, a length of film 140 is placed on base member top 20 such that the sprocket holes of the film are inserted on first pair of register pins 40 and second pair of register pins 44. Movable knife support lever 60 is then rotated by approximately ninety (90) dgerees such that first film seating plate 66 and second film seating plate 70 are brought into contact with the length of film 140. This view of shown in FIG. 3. Spaced openings 68 in first film seating plate 66 accommodate the first pair of register pins 40 and the first film seating plate 66 is aligned with first movable film ejection plate 42. Similarly, spaced openings 72 in second film seating plate 70 accommodate the second pair of register pins 44 and the second film seating plate 70 is aligned with second movable film ejection plate 46. Through this process, the film 140 is securely pressed against the top 20 of base member 10 before any film is cut.

Handle member 82 is then pressed downwardly toward the movable knife support lever as shown in FIG. 8. This is also shown in FIG. 9. As the handle member 82 is moved downwardly, first longitudinal arm 90 is also caused to move downwardly. As the first longitudinal arm 90 moves downardly, its forward front portion which is the film cutting knife 100 also moves downwardly. As shown in FIG. 8, the film cutting knife 100 is offset to form the general shape of a right triangle with the apex at the front end. As the film cutting knife moves downard, the movable film support plate 50 moves downwardly while the movable film support plate spring 52 is compressed. Since the area of the length of film being cut is sandwiched between the top of the film cutting knife 100 and the movable film supprt plate 50 for the entire cut, the result is a very smooth and even cut along the entire distance of the width of the film.

One novel safety feature designed into the present invention is a method of assuring that the operator will not accidentally cut his finger during this process. It is possible to move the handle member 82 toward the movable knife support lever 60 while the film cutter is in the at rest position shown in FIG. 1. As this is done, the top of the handle arms 84 and 86 move downward and rearwardly. As a result, as the movable knife support lever 60 is rotated downwardly toward the base member 10 with the film cutter knife 100 in the fully extended position, the exposed portion 87 of shaft 88 (see FIG. 4) hits the top of hook 58. Therefore, the movable knife support lever 60 with fully extended film cutting knife 100 is prevented from moving further toward the top 20 of base member 10. Therefore, the operator can not accidentally cut his finger.

Similarly, assuming the Film Cutter 200 has been operated properly and the film cutting knife 100 is not exposed while the movable knife support lever 60 is being rotated toward top 20 of base member 10, the front tip of handle arms 84 and 86, the front of second longitudinal arm 92, and the shaft 88 which connects the three, fit into opening 56. Once the film seating plates 66 and 70 are in contact with the length of film 140 as previously described, the downward movement of handle 82 causes the tip of the handle arms 84 and 86, the tip of second longitudinal shaft 92 and the shaft 88 to move backward so that the exposed portion 87 of shaft 88 fits into hook opening 54 of hook 58 in transverse beam 102 as shown in FIG. 7. Therefore, after the cut has been made, the handle assembly 80 remains in a locked position and cannot fly open. Spring 112 located between transverse protrusion 61 on lever support arm 60 and shaft 106 on fixed transverse beam 102 then causes the movable knife support lever 60 and the attached movable knife actuation assembly 80 to rotate back to its original position shown in FIG. 1.

The now cut lengths of film 140 can be removed by one of two alternative processes. If it is desired to remove only one of the lengths of film, the finger pedals are used. This is illustrated in FIG. 9 where the first finger pedal 30 is actuated. A downward force from the finger of the operator causes first finger pedal 30 to move downwardly in opening 28. As this is done, first finger pedal arm 31 rotates about finger pedal shaft 114 such that the forward tip of first finger pedal arm 31 moves upwardly. This serves to force the first film ejection plate support shaft 116 and its components 118 and 120 upward and also serves to comopress first ejection plate support shaft spring 122. As shown in FIG. 9, this causes first ejection support plate 42 to move upwardly and thereby causes the cut portion of film 140 resting on first film ejection support plate 42 to be removed from the top 20 of base member 10. This cut length of film is then removed. This process can be repeated for the second finger pedal 34 through its second finger pedal arm 35 to actuate the second film ejection plate 46. The finger pedals are used to remove the lengths of film 140 when it is desired to remove one or both cut halves separately. For example, a second length of film can be placed on the register pins while the right half of the previous cut length of film remains on the second pair of register pins after the left half of previously cut film has been removed as shown in FIG. 9. The second length if film is then cut as previously described and the right half is removed. The right half of the first length of film and the left half of the second length of film can then be taped together. At this point, it is desirable to remove both lengths of film at the same time.

The alternative method of ejecting film is shown in FIG. 6. With the movable knife support lever 60 and movable knife actuating assembly 80 returned to the at rest position, handle 82 is moved toward movable film actuating lever 60. In addition to causing film cutting knife 100 to move forward (or downward when the movable knife support lever 60 is generally parallel to the top 20 of base memebr 10), second longitudinal arm 92 moves downwardly. As a result, transverse protrusion 94 on second longitudinal slide arm 92 also moves downwardly while depressing spring 99 inside slot 101 inside of arm 92. This in turn causes the rear portion 108 of internal lever arm 104 to move downwardly. As the internal lever arm 104 pivots about shaft 106 on transverse beam 102, the front portion 110 of internal lever arm 104 moves upwardly. As it does so, the rear ends of first finger pedal arm 31 and second finger pedal arm 35 are also moved upwardly at the same time and by the same amount, and with the same speed. By the method previously descriubed for the actuation of the finger pedals individually, both film ejection plates 42 and 46 move upward and eject both sides of the film simultaneously. When the pressure on the handle 82 is released, the return force from springs 122 and 130 and also from spring 99 cause the handle 82 and movable film ejection plates 42 and 46 to return to their original position and the internal lever 102 rotates back to its original position.

Of course, the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the va&k120H might be embodied or operated.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. A film Cutter comprising:

a. a hollow base member including a front wall, a first side wall, a rear side wall, a second side wall, a top and a bottom;

b. the front wall of said base member containing a first opening and a second opening located in spaced parallel relationship to each other;

c. said first opening accommodating a first finger pedal;

d. said second opening accommodating a second finger pedal;

e. said first and second finger pedals being rotatably supported to permit downward movement of each finger pedal within its opening;

f. the top of said base member containing a first fixed pair of pins spaced apart by the widthwise mid-point distance between sprocket holes on a length of motion picture film;

g. the top of said base member further containing a second fixed pair of register pins spaced apart by the widthwise mid-point distance between sprocket holes on a length of motion picture film;

h. said first and second pairs of register pins spaced part from each other in generally parallel relationship;

i. a first movable film ejection plate surrounding said first pair of register pins and supported on the base member such that its surface is parallel to the top of the base member;

j. a second movable film ejection plate surrounding said second pair of register pins and supported on the base member such that its surface is parallel to the top of the base member;

k. connecting means between said first movable film ejection plate and said first finger pedal such that the first movable film ejection plate moves upwardly away from the base member when the first finger pedal is depressed;

l. connecting means between said second movable film ejection plate and said second finger pedal such that the second movable film ejection plate moves upwardly away from the base member when the second finger pedal is depressed;

m. the top of said base member containing a longitudinal opening between the first and second movable film ejection plates;

n. a movable film support plate located within said longitudinal opening between the first and second movable film ejection plates with its upper surface parallel to the top of the base member;

o. a spring supporting the movable film support plate within the longitudinal opening;

p. a second opening in the top of the base member located to the rear of the movable film support plate;

q. a movable knife support lever rotatably supported on a shaft at the rear of the base member and located at generally a right angle to the base member in its at rest position;

r. the front face of the movable knife support lever containing a first film seating plate with a pair of openings such that the first film seating plate is aligned with the first film ejection plate and the openings accommodate the first pair of register pins when the movable knife support lever is rotated into parallel relationship with the top of the base member;

s. the front face of the movable knife support lever containing a second film seating plate with a pair of openings such that the second film seating plate is aligned with the second film ejection plate and the openings accommodate the second pair of register pins when the movable knife support lever is rotated into parallel relationship with the top of the base member;

t. the movable knife support lever further comprising a centrally disposed longitudinal opening which accommodates a movable knife actuating assembly;

u. said movable knife actuating assembly comprising a handle member extending into a pair of spaced parallel handle arms joined at their forward end by a shaft, the pair of handle arms pivotally and rotatably supported on a first longitudinal arm and a second longitudinal arm which are in turn pivotally and rotatably supported on said movable knife support lever;

v. the upper front edge of the first longitudinal arm containing the film cutting knife which is aligned with the movable film support plate when the movable knife support lever is brought into parallel relationship with the top of the base member and the handle member is activated and pressed toward the movable knife support lever;

w. the interior hollow portion of the base member containing a fixed transverse beam which contains a hook and whose upper portion extends into the second opening in the top of the base member;

x. an internal lever arm pivotally supported by a shaft on said fixed transverse beam and extending within the base member such that its rear portion abuts the lower portion of the second longitudinal arm and its forward portion is in contact with the lower portion of the first and second finger pedals; and y. a spring interconnecting the shaft which supports the internal lever arm and the lower portion of the first longitudinal arm.

* * * * *